US008689320B2

(12) United States Patent
Okuda

(10) Patent No.: US 8,689,320 B2
(45) Date of Patent: Apr. 1, 2014

(54) IMAGE FORMING APPARATUS WITH HARD DISK DRIVE SECURELY FORMATTED

(75) Inventor: Masaya Okuda, Chuo-ku (JP)

(73) Assignee: Kyocera Document Solutions Inc., Osaka (JP)

( * ) Notice: Subject to any disclaimer, the term of this patent is extended or adjusted under 35 U.S.C. 154(b) by 1774 days.

(21) Appl. No.: 11/727,263

(22) Filed: Mar. 26, 2007

(65) Prior Publication Data

US 2007/0222810 A1 Sep. 27, 2007

(30) Foreign Application Priority Data

Mar. 24, 2006 (JP) ..... 2006-083812
Mar. 24, 2006 (JP) ..... 2006-083813

(51) Int. Cl.
*G06F 21/00* (2013.01)
*G06F 13/00* (2006.01)

(52) U.S. Cl.
USPC ..... 726/16; 358/1.15; 358/1.13; 714/6

(58) Field of Classification Search
USPC ..... 358/1
See application file for complete search history.

(56) References Cited

U.S. PATENT DOCUMENTS 4,628,359 A * 12/1986 Okada et al. ..... 380/241
6,348,974 B1 * 2/2002 Takahashi et al. ..... 358/1.16
6,351,850 B1 * 2/2002 van Gilluwe et al. ..... 717/175
6,819,446 B1 * 11/2004 Ogawa et al. ..... 358/1.15
7,093,295 B1 * 8/2006 Saito ..... 726/26
7,471,408 B2 * 12/2008 Ueda et al. ..... 358/1.15
2003/0090705 A1 * 5/2003 Ferlitsch ..... 358/1.15
2004/0120004 A1 * 6/2004 Okamoto et al. ..... 358/1.15
2005/0088680 A1 * 4/2005 Ahn ..... 358/1.14
2005/0111034 A1 * 5/2005 Karasaki et al. ..... 358/1.15
2005/0116780 A1 * 6/2005 Endo et al. ..... 331/2
2005/0231756 A1 * 10/2005 Maeshima ..... 358/1.15
2006/0038820 A1 * 2/2006 Kitani ..... 345/531
2006/0077424 A1 * 4/2006 Maruta et al. ..... 358/1.15

(Continued)

FOREIGN PATENT DOCUMENTS

JP 2003-58486 2/2003
JP 2004-139163 5/2004
JP 2005-96082 4/2005
JP 2005-96082 A 4/2005

OTHER PUBLICATIONS

"Clean Disk Drive—How to Clean a Disk Drive", Mar. 17, 2006, White Canyon, pp. 1-5.*

(Continued)

*Primary Examiner* — Andrew Goldberg
(74) *Attorney, Agent, or Firm* — Browdy and Neimark, PLLC

(57) ABSTRACT

If the validity of authorization information read from a USB key is verified (S1 to S4), use-information that indicates "used" is written in both of the nonvolatile memory and the USB key (S7). In a case of an initial use of an image forming apparatus (Cp=1, S8), a screen for selecting whether to perform a secure format on a hard disk device or not is displayed on a control panel (S9). If an instruction from the control panel indicates performing a secure format (S10), or if the use of the image forming apparatus is not a first time (Cp>1, S8), overwrite process on the hard disk with dummy data device is performed (S13, S14), and a logical format is performed regardless of a selection on the screen (S16).

1 Claim, 5 Drawing Sheets

(56) References Cited

U.S. PATENT DOCUMENTS

| | | | | |
|---|---|---|---|---|
| 2006/0182417 | A1* | 8/2006 | Sugishita | 386/95 |
| 2007/0028137 | A1* | 2/2007 | Chen | 714/6 |
| 2007/0086036 | A1* | 4/2007 | Tanaka | 358/1.13 |
| 2008/0037054 | A1* | 2/2008 | Hasegawa et al. | 358/1.15 |

OTHER PUBLICATIONS

Partition Magic 7.0—User Guide, Aug. 2001, PowerQuest, pp. 1-221.*

Chinese Office Action dated Nov. 21, 2008, in re counterpart patent Appln. No. 20071008137.9.

* cited by examiner

FIG2.A
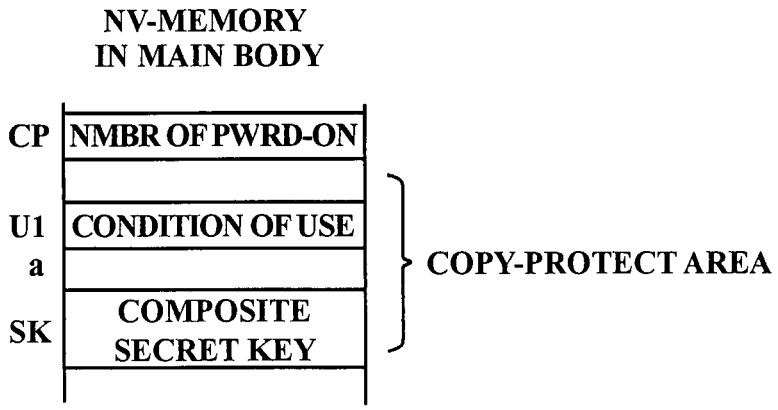
FIG2.B
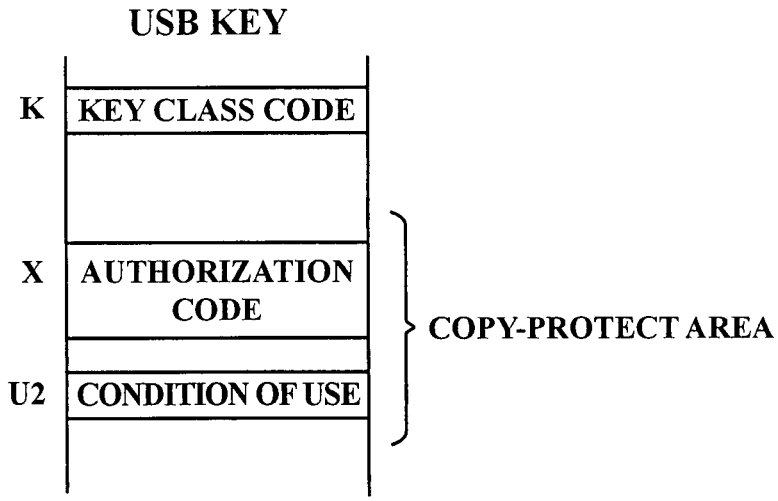

IMAGE FORMING APPARATUS WITH HARD DISK DRIVE SECURELY FORMATTED

CROSS-REFERENCE TO RELATED APPLICATIONS

This application is based upon and claims the benefit of priority from the prior Japanese Patent Application No. 2006-083812 and 2006-083813, filed on Mar. 24, 2006, the entire contents of which are incorporated herein by reference.

TECHNICAL FIELD

The present invention relates to an image forming apparatus, such as a printer, a copier, a facsimile machine, a multi-function peripherals, that carries a sheet to form images thereon and is equipped with a hard disk, and more specifically to an image forming apparatus with function to format an equipped hard disk with ensuring security.

BACKGROUND OF THE INVENTION

Due to an increasing amount of data to be stored, an image forming apparatus is often equipped with a hard disk drive. Since an image forming apparatus is, generally speaking, used communally by a plurality of people, it is necessary to ensure the security of data in the hard disk.

JP No. 2004-139163-A discloses a configuration wherein a unique identification number of an image forming apparatus is stored in a nonvolatile memory which is installed in the image forming apparatus; the unique identification number, when storing data in the nonvolatile memory, is used as a key to encrypt the data, and; the key is used to decode the encrypted data when reading the data from a hard disk of the image forming apparatus.

With this configuration, data in a hard disk of an image forming apparatus cannot be decoded by, for example, installing the hard disk on another image forming apparatus.

Also, JP No. 2005-96082-A discloses a method of disabling the restoration of files that are deleted from a hard disk by overwriting the stored area of the files with dummy data such as 0 when deleting the files, in order to secure the deleted files.

On the other hand, JP No. 2003-58486-A discloses a method of activating an optional routine that is preinstalled as an inactivated state in advance, on condition that an SD card key on which ID data and encrypting data are written is inserted in an image forming apparatus and that the two sets of data are verified to be valid.

However, selection of a hard disk format method may be different, for users who need a process of ensuring security when they first set up an image forming apparatus, and for users who do not need the process until later. On the other hand, understanding and selecting a hard disk format method is not easy for general users, possibly resulting in a loss of user's time.

Besides, users are not aware of a necessity of a process to ensure the security, such as the process above, at first. If a user attempts to perform the process when the user realizes a necessity of the process later, the user has to replace an image forming apparatus with the one with function for such a process, adding a burden to the user.

If a configuration allows for activation of an optional routine in accord with the insertion of a key when a user realizes a necessity of the process with function to ensure the security, with the optional routine preinstalled on an image forming apparatus, there is a high possibility to execute the function by mistake by a user, especially if the image forming apparatus is communal to many people. If a configuration requires users to call for service personnel to execute the process, the cost is high and reservation for the service is required, both aspects being inconvenient for users.

SUMMARY OF THE INVENTION

Accordingly, it is an object of the present invention to provide an image forming apparatus capable of readily and properly executing a hard disk format upon selecting a format method, both for users who need a process of ensuring security since they first set the image forming apparatus, and for users who do not need the process until later.

Another object of the present invention is to provide an image forming apparatus capable of executing a security ensuring process for a hard disk without an error at a point when a user realizes a necessity of the process.

In a first aspect of the present invention, a format routine orders a processor to perform the steps of:

(a) performing an overwrite process which writes dummy data onto each sector in a hard disk drive if it is determined that the use of the image forming apparatus is not a first time; and (b) performing a logical format on the hard disk drive regardless of the determination in the step (a).

According to the above configuration, since it is presumable that data to be secured is stored in the hard disk if the use of the image forming apparatus is not a first time, the format routine orders a processor to perform the overwrite process, assuming the overwrite process is selected. Therefore, there is an advantage in that user is able to readily execute a hard disk format.

In a second aspect of the present invention including the first aspect, and the routine orders the processor, in the step (a), to display, on display means, a screen to select whether to perform the overwrite process if it is determined that the use of the image forming apparatus is a first time, and to perform the overwrite process if an instruction from instruction inputting means indicates performing the overwrite process.

The above configuration leaves options to a user whether to execute the overwrite process if the image forming apparatus is used for the first time, considering a case that the user printed out a confidential document, although there is no necessity to perform an overwrite process with dummy data after printing out a non-confidential document. Therefore, there is an advantage in that user is able to properly execute a hard disk format upon selecting a format method.

In a third aspect of the present invention, use-information that indicates either "unused" or "used" is stored in a nonvolatile memory, and a program orders the processor to perform the steps of:

(a) reading authorization information from a memory key if the memory key is coupled to the coupling means and the use-information indicates "unused";

(b) determine whether the authorization information is valid or not; and (c) if the determination is positive, writing use-information that indicates "used" on the nonvolatile memory, writing dummy data on each sector, and performing a logical format on a hard disk device.

With the above configuration, the program orders the processor to read an authorization information from a memory key if the use-information indicates "unused", determine whether the authorization information is valid or invalid, and write the use-information that indicates "used" on a nonvolatile memory if the validity of the authorization information is verified, and the overwrite process will not be executed once "used" is indicated regardless of any memory key being coupled to its connecting means, preventing a user from committing an error in operation.

Other aspects, objects, and the advantages of the present invention will become apparent from the following detailed description taken in connection with the accompanying drawings.

BRIEF DESCRIPTION OF THE DRAWINGS

FIG. 2A is an illustration of a portion of contents of a nonvolatile memory installed in a main body of an image forming apparatus;

FIG. 2B is a memory map showing a portion of memory contents of a USB key;

DESCRIPTION OF THE PREFERRED EMBODIMENT

Figure 1:
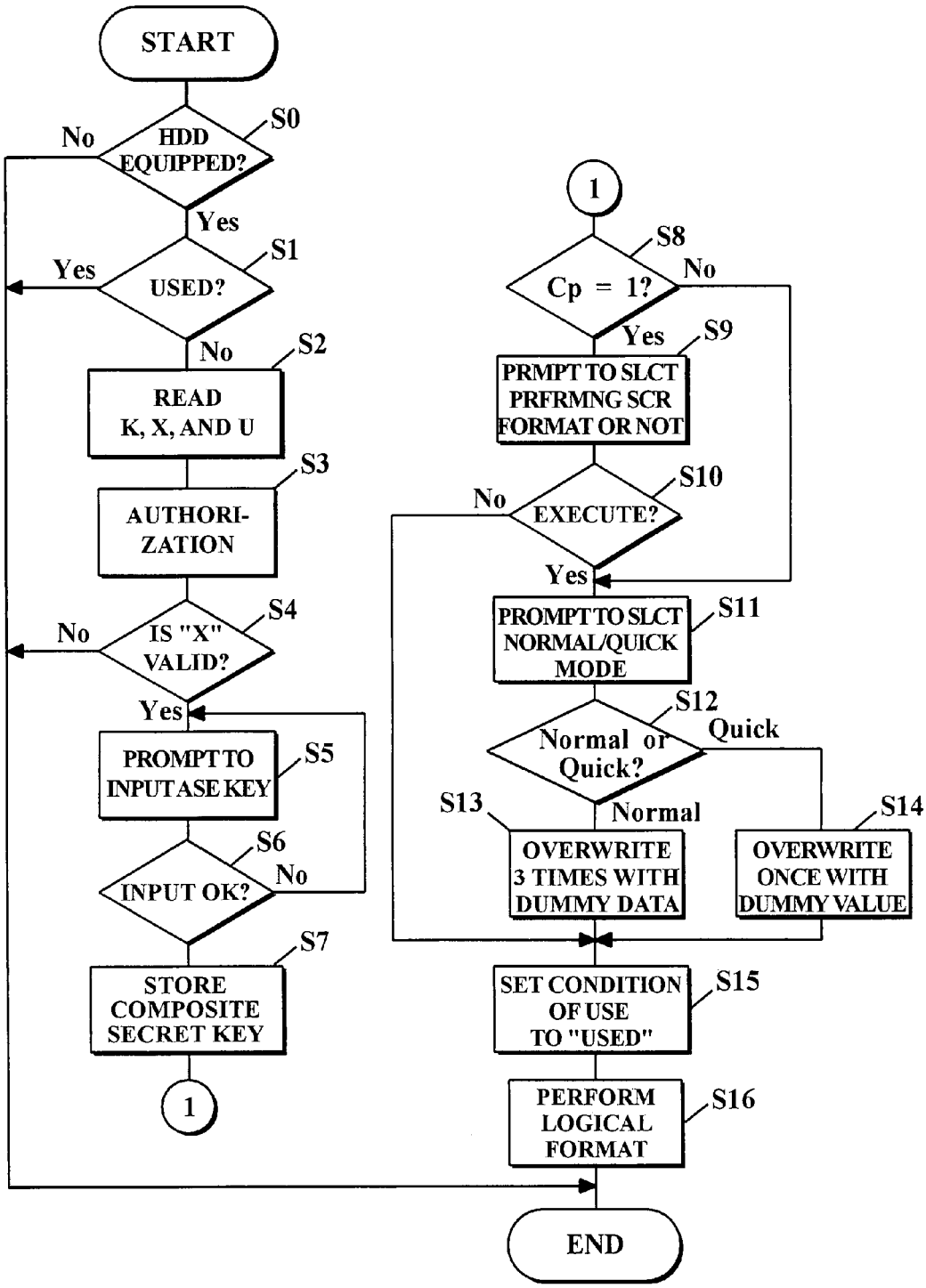
FIG. 1 is a flowchart of a hard disk security ensuring process among processes executed after the insertion of a USB memory, of a first embodiment according to the present invention.

Referring now to the drawings, wherein like reference characters designate like or corresponding parts throughout several views, a preferred embodiment of the present invention will be described below.

Figure 5:
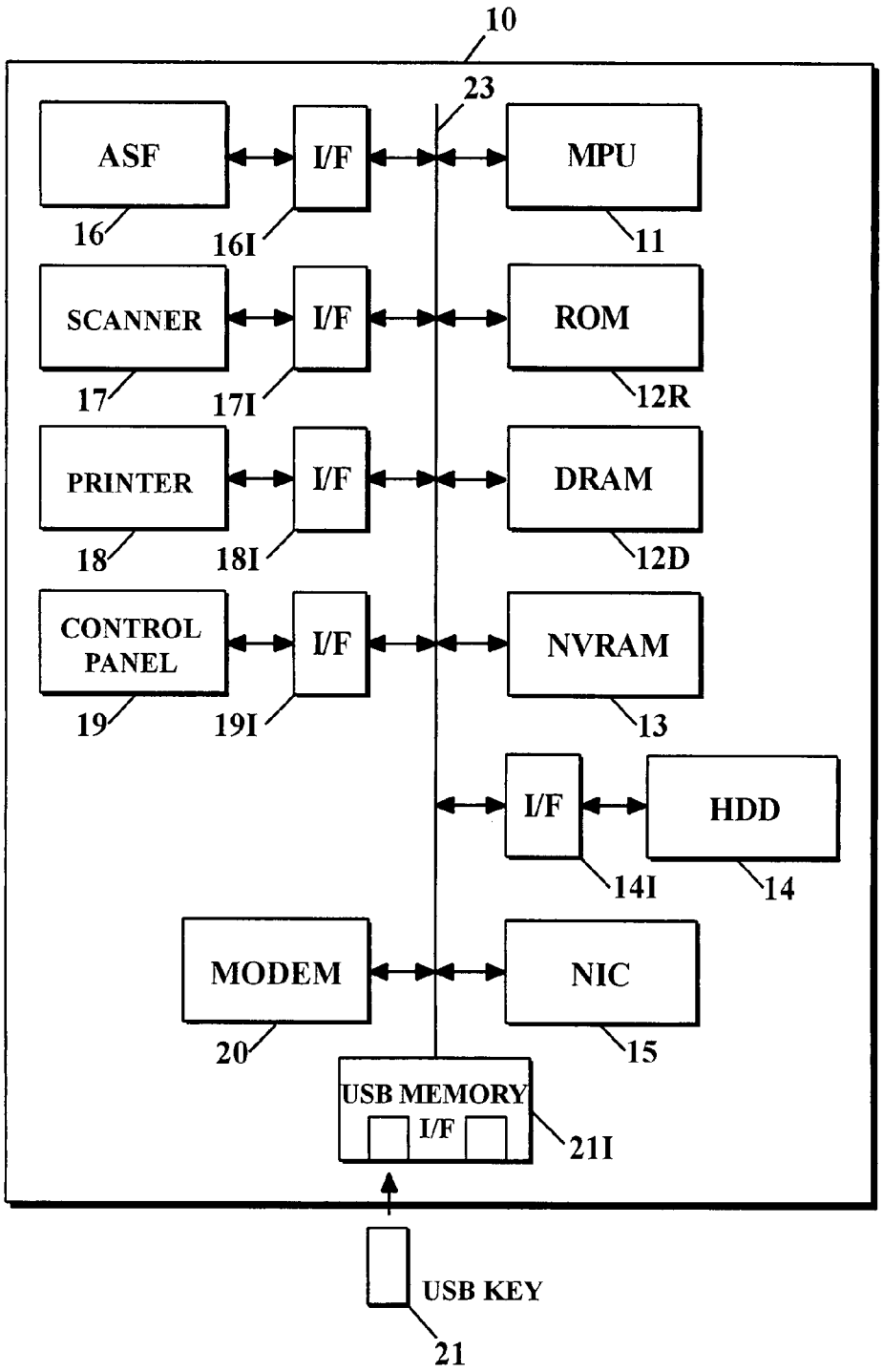
FIG. 5 is a schematic block diagram of an image forming apparatus of the first embodiment.

FIG. 5 is a schematic block diagram of an image forming apparatus 10 relating to a first embodiment according to the present invention.

In this image forming apparatus 10, an MPU (Micro Processing Unit) 11, a ROM 12R, a DRAM 12D, an NVM (Nonvolatile Memory) 13, an NIC (Network Interface Card) 15, a modem 20, interfaces 14I, 16I to 19I, and 21I are coupled through a BUS 23. The interfaces 14I and 16I to 19I are coupled to a HDD (Hard Disk Drive) 14, an automatic sheet feeder 16, a scanner 17, a printer 18, and a control panel 19, respectively.

The ROM 12R stores a boot strap, an operating system (OS), an application operating at an upper layer of the OS, and various device drivers operating at a lower layer of the OS. This application is to have the image forming apparatus operate as a multifunction peripherals, and a secure format program is included herein. This secure format is termed a process of overwriting all files and storing areas of an FAT (File Allocation Table) with dummy data, or overwriting all sector regions with dummy data continuously by the sector unit in a state where a physical format has been performed (a state where a series of index numbers for reading and writing data are attached to each sector) while disregarding a logical format, and performing a logical format afterwards. The function of the multifunctional machine includes copying, scanning, printing, and sending and receiving facsimiles.

The DRAM 12D is used as a main memory. An example of the NVM (nonvolatile memory) 13 is a flash memory. The NVM 13 can be electrically rewritten. A "Cp" in a FIG. 2A, or the number of times that the power has been turned on, a condition of use "U1", and a composite secret key "SK" are stored in a copy-protect area of the NVM 13. If data in the copy-protect area is attempted to be read, stored data is read in an encrypted form and thus is dummy data for those who do not know a secret key. A condition of use "U1" is for a secure format, and a composite secret key "SK" is for encryption and decryption, both relating to a hard disk 14 and being further described in the following.

Connected to an exterior host computer on a network, the NIC 15 is used for print jobs. The scanner is to input images in accord with the automatic sheet feeder 16, used for copying and sending facsimiles. The printer 18 is equipped with a print engine, imprint equipment, a paper feeder, a paper conveyer, and a paper discharger. Based on bit map data supplied as print data, the printer 18 forms an electrostatic latent image in a photoconductor drum of print engine, develops the electrostatic latent image with a toner, transcribes the electrostatic latent image onto paper, imprints the electrostatic latent image, and discharges the paper. The control panel 19 is equipped with a display and a key input section, and is to input setting information or instructions and display a selection screen, a setting screen, etc. The modem 20 is for sending and receiving facsimiles. The USB (Universal Serial Bus) memory interface 21I is equipped with a port for the USB key 21 as a memory key, enabling free attachment and detachment of the USB key 21.

The USB key 21 is a USB memory, equipped with a NVM such as a flash memory chip, and stores a key type code "K", an authorization code "X", and a condition of use "U2", as described in FIG. 2B. These "K", "X" and "U2" are for a secure format, which will be further described below. The authorization code "X" and the condition of use "U2" are stored in the same copy-protect area as mentioned above.

Next, a portion of the application mentioned above is explained.

Due to the above-mentioned overwrite process, a secure format requires more time than a standard format requires. Therefore, a standard format is executed if there is no particular need for a secure format. However, according to changes in work contents of a user, a necessity for a secure format varies. When performing a secure format, a user inserts the USB key 21 in the port of the USB memory interface 21I. Following the insertion of the USB key 21, the USB key 21 is detected by means of a cut-in process, and hard disk security ensuring process, shown in FIG. 1, will be started. FIG. 1 is a flow chart of the hard disk security ensuring process among processes being executed after the insertion of a USB memory. This process is performed by a program stored in a ROM 13. Symbols in parenthesis are step identifying symbols in the drawings.

The hard disk drive 14 is assumed to have been physical-formatted at the time of shipping from a factory.

(S0) Said program determines whether the hard disk drive 14 is equipped or not, and if the hard disk drive is equipped, proceeds to a step S2; if the hard disk drive is not equipped, the program ends the process of FIG. 1.

(S1) The condition of use "U1" (FIG. 2A) is read from the NVM 13, and the program ends the process of FIG. 1 if the "U1" indicates "used", or proceeds to a step S2 if the "U1" indicates "unused".

(S2) A "K", an "X", and a "U2" of FIG. 2B are read from a predetermined address in the USB memory. If this USB memory is a USB key 21, the contents of "K" are a value that indicates an activation key of hard disk security ensuring function, the contents of "X" are an authorization code that gives a permission of a use of the USB key 21, and the contents of "U2" are a condition of use that indicates either "used" or "unused".

(S3) If the value of the key type code "K" indicates the activation key of hard disk security ensuring function and the condition of use "U2" indicates "unused", the program determines whether the authorization code "X" is valid or invalid. This judgment can be conducted by substituting "X" in a predetermined function f. If a=f(X), which was calculated from the substitution, coincides with a predefined value, the validity of the authorization code "X" is verified. In other words, the value "a" in the authorization code "X" and the function "f" is defined to be equal to a predefined value if the authorization code "X" is valid. This predefined code "a" is stored in a copy-protect area of the NVMRA 13 (FIG. 2A).

(S4) The program proceeds to a step S5 if the authorization code "X" was determined to be valid, and ends the process of the FIG. 1.

Figure 3A:
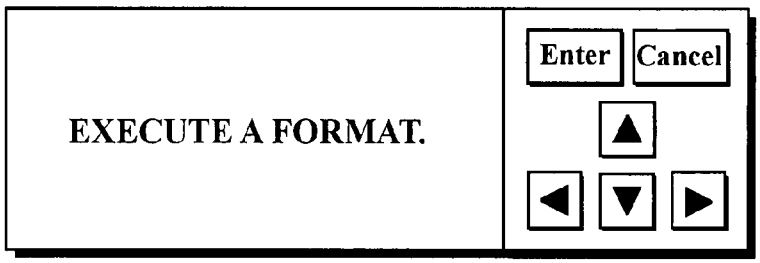
FIGS. 3A to 3C are illustrations of a display on a control panel in a FIG. 1 process.
Figure 3B:
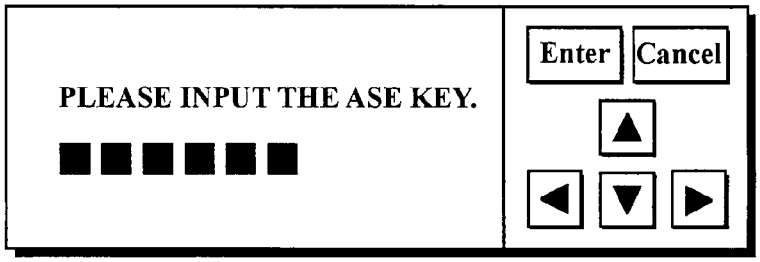

(S5) First, as shown in FIG. 3A, the confirmation screen of whether to execute a secure format or not is displayed on the display of the control panel 19. In this control panel 19, an Enter key, a Cancel key, and arrow keys are placed on a right side of the display. These keys are hardware keys or software keys on a touch panel.

Data encryption/decryption to the hard disk 14 is independent to a secure format selection in the following steps S9 and S10. The following AES (Advanced Encryption Standard) key is for data encryption/decryption, and is not directly relevant to a secure format.

Figure 3C:
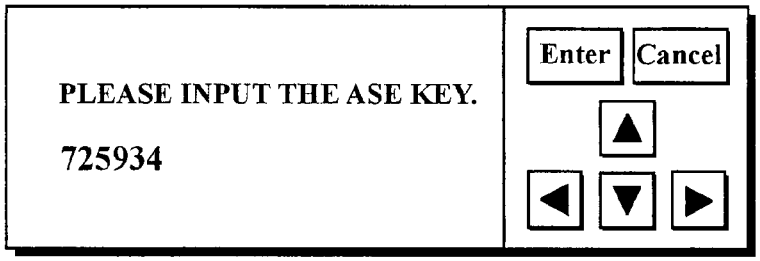

Followed by user's pressing an Enter key, a sentence "Please input the AES key" appears on the display, with six black rectangles to input each digit of a six-digit number below the sentence. Pressing up/down arrow keys replaces the first (the very left) rectangle with a number and increments/decrements the number. Pressing right arrow key replaces a next black rectangle with a 0, and up/down arrow keys changes this number similarly. FIG. 3C is an exemplifying diagram of the display after inputting all six digits. Pressing an Enter key at this state leads to a step 7 in FIG. 1.

(S7) A unique machine ID code MID of the image forming apparatus is read by, for example, the printer 18 and the scanner 17, combined with the ASE key input in the step 5, and encrypted. This encrypted code is stored in the NVM 13 as a composite secret key "SK" (FIG. 2A).

This composite secret key "SK" is used for, in jobs after the process of FIG. 1, encryption to the hard disk 14 before writing data, and decryption to the hard disk 14 after reading data. These encryption and decryption are executed as a part of the process of hard disk drive, regardless of the application and the USB key 21.

(S8) The program proceeds to a step S9 if the "Cp" is 1. The initial value of this "Cp", or the number of times that the power has been turned on, is set to 0. The "Cp" is incremented by 1 through an initializing routine of the application every time the power is turned on, but will not be incremented if the "Cp" has reached to a certain value, such as 2, in order to avoid the "Cp" returning to a value 1.

The reason for proceeding to a step S9 when the Cp=1 is to let users choose whether to perform a secure format or not, since a secure format is not required in a case where a user printed out a non-confidential document after installing an image forming apparatus, supplying the power to it, and inserting the USB key 21 in a port of the interface 21I. On the other hand, the program proceeds to a step S11 in a case where the Cp>1, assuming a user has chosen to perform a secure format, due to a high possibility that data whose security should be ensured is stored in the hard disk, and because a user inserting the USB key 21 in a halfway implies that the user desires to ensure the security of data in the hard disk.

Figure 4A:
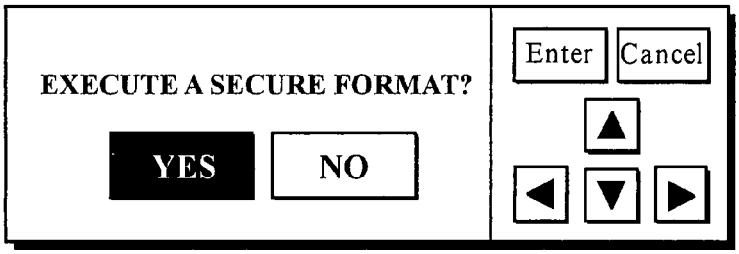
FIGS. 4A to 4D are illustrations of a display on a control panel in a FIG. 1 process.

(S9) As shown in FIG. 4A, the program displays a selection screen of whether performing a secure format or not.

(S10) The program proceeds to a step S11 if "Yes" is selected, and to a step S15 if "No" is selected.

Figure 4B:
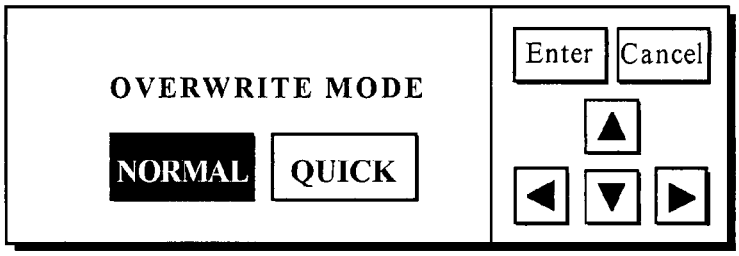

(S11 to S14) As shown in FIG. 4B, the program displays a selection screen of whether an overwrite mode is "normal" or "quick". Here, "quick" is an overwrite mode in which all sectors are overwritten once with a value such as 0. In contrast, "normal" is an overwrite mode in which all sectors are overwritten more than once, three times for example, with a first and a second times overwriting continuously with random numbers and a third time overwriting continuously with a value such as 0. With this normal mode which bars overwritten data from being read in the future even if the residual magnetism is read, the security is further ensured.

As shown in FIG. 4B, a normal mode is inversely displayed and selected in an initial state, thereby this mode is confirmed when a user presses an "Enter" key. To choose a quick mode, a user presses a "quick" button to select the quick mode, and presses an "Enter" key to confirm the quick mode. In a case where a normal mode is selected, the program displays FIG. 4C and blinks a sign of "Secure Formatting".

Depending on a mode selected, either one of the overwrite processes above is performed.

(S15) The program writes "used" on the above the condition of use "U1" and "U2" of the NVM 13 and the USB key 21. Thereby, the USB key 21 will not be accepted after a secure format is performed once, and the USB key 21 will not be able to be utilized for other image forming apparatuses, preventing another execution of a secure format by user's mistake and an unnecessary secure format.

Figure 4C:
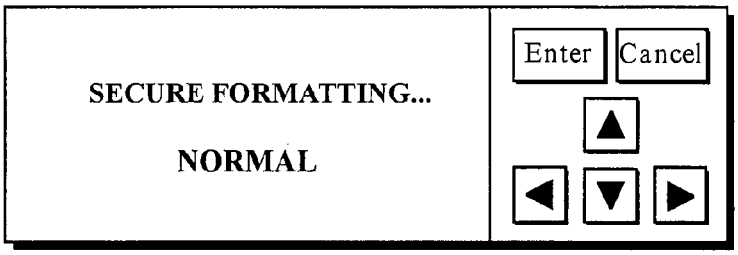
Figure 4D:
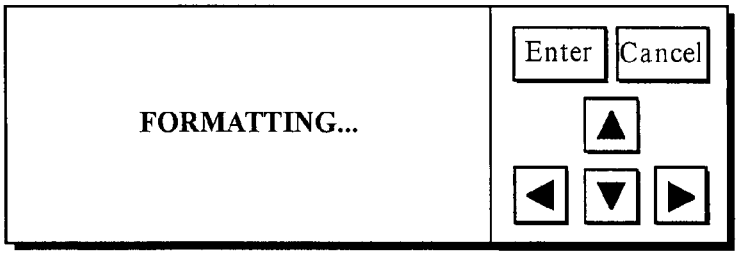

(S16) Next, a logical format is executed onto the hard disk 14. If a negation is selected in the step S10, FIG. 4D is displayed and a sign of "Formatting" is blinked during this logical format. In a case of a secure format, FIG. 4C is displayed in this step S16 as well, and a sign of "Secure Formatting" is blinked. The program ends the process of FIG. 1 after the logical format.

As explained above, according to this embodiment, the configuration leaves options to a user whether to execute the overwrite process if the image forming apparatus is used for the first time, considering a case that the user printed out a confidential document, although there is no necessity to perform an overwrite process with dummy data after printing out a non-confidential document. Because it is presumable that data to be secured is stored in the hard disk if the use of the image forming apparatus is not the first time, the format routine orders a processor to perform the overwrite process, assuming the overwrite process is selected. Therefore, an effect that user is able to readily and properly execute hard disk format upon selecting a format method is achieved.

In addition, the condition of use that indicates either "unused" or "used" is stored in the NVM 13; in a case where the USB key 21 is inserted in a port and the condition of use indicates "unused", an authorization information "X" is read from the USB key 21 and validity of the authorization information "X" is checked. If the validity of the authorization information "X" is verified, the condition of use that indicates "used" is written in the NVM 13 and the process is executed. Because the overwrite process will not be performed anymore regardless of which USB key is inserted in a port after the condition of use set to "used", users' unintentional operation can be prevented.

Besides, the condition of use that indicates either "unused" or "used" is stored in the USB key 21, and "used" is written in the USB key 21 as well when storing "used" as described above. Since the program proceeds to the above-mentioned authorizing step only when the condition of use indicates "unused", a secure format will not be executed even if the USB key 21 is inserted in other image forming apparatuses, realizing easy management of respective memory keys for multiple image forming apparatuses.

Moreover, by displaying a screen for selecting a normal mode and a quick mode which require different time for an overwrite process, and by the number of times of overwriting dummy data onto each sector in the hard disk being correspondent to a selected mode, a level of security to be ensured can be selected according to a user's time allowance with a simple configuration.

Furthermore, a user can execute a secure format when the user feels a need to without replacing an image forming apparatus with a new image forming apparatus. Plus, by having an administrator manage the USB key 21, an unintentional elimination of necessary data from the hard disk 14 by other users can be prevented, since a secure format cannot be performed unless inserting the USB key 21 in the USB memory interface 21I. Also, because a secure format can be performed by inserting the USB key 21 in the USB memory interface 21I, requesting outside service personnel for a secure format is unnecessary, resulting in a decrease in cost and a timely execution of a secure format when a user feels a need for a secure format.

Although a preferred embodiment of the present invention has been described, it is to be understood that the invention is not limited thereto and that various changes and modifications may be made without departing from the spirit and scope of the invention.

For example, an acceptable configuration of the invention may use a count value of the number of print pages instead of the number that the power has been turned on, and the same process as the case of the Cp=1 if the count value is under a certain value.

In addition, although a case where an interface for removable memory device is a USB memory interface 21I has been described in the aforementioned embodiment, the interface may be other one of various removable memory cards and removable hard disks.

Moreover, although a case where an image forming apparatus is a multifunction peripherals has been described in the aforementioned embodiment, it should be understood that the present invention is also applicable to a single-function image forming apparatus.

What is claimed is:

1. An image forming apparatus for forming an image on a supplied sheet, comprising:

a processor;

a hard disk drive coupled to the processor;

program storing means, coupled to the processor, for storing a program;

control means, coupled to the processor, equipped with instruction inputting means and display means, a detection means that detects whether the use of the image forming apparatus is a first time or not, a rewritable nonvolatile memory, coupled to the processor, for storing use-information that indicates either "unused" or "used" and is coupled to the processor, a coupling means to which a memory key comprised of a removable memory device is coupled; and an interface for a removable memory device coupled in between the coupling means and the processor, wherein the program includes a routine to format the hard disk drive, and wherein the routine orders the processor to perform the steps of:

(a) if it is detected that the use of the image forming apparatus is a first time, 1) displaying, on the display means, a screen to select whether to perform a physical format with overwriting dummy data onto each sector in the hard disk drive, and 2) performing the physical format if it is detected that the use of the image forming apparatus is not a first time, or if an instruction from the instruction inputting means indicates that the overwrite process should be performed;

(b) performing a logical format on the hard disk drive;

(c) reading authorization information from the memory key if the memory key is coupled to the coupling means and the use-information indicates "unused";

(d) determining whether the authorization information is valid or not; and (e) if the validity of the authorization information is verified, writing use-information that indicates "used" on the nonvolatile memory and proceeding to the step (a), wherein step (a) includes a determination of how many times power of the image forming apparatus has been turned on, and the detection determination in step (a) determines that the number of times that the power of the image forming apparatus has been turned on is one, wherein the memory key stores use-information that indicates either "unused" or "used", wherein the program orders the processor to perform the step of, after the step (e), writing use-information that indicates "used" on the memory key, wherein step (c) comprises reading the use-information from the memory key, and proceeding to the step (d) only when the use-information indicates "unused", wherein step (a) further comprises displaying a screen for selecting a first mode and a second mode whose overwriting times are different to each other, wherein the number of times of writing dummy data onto each sector corresponds to one of the first and second modes selected by the instruction inputting means, and wherein a user inputs a key into the display of the image forming apparatus to aid in the creation of a secret key in order to encrypt to a hard disk before writing data and decrypt to the hard disk after reading data.

* * * * *